United States Patent [19]

Bartok et al.

[11] 4,388,062

[45] Jun. 14, 1983

[54] MULTI-STAGE PROCESS FOR COMBUSTING FUELS CONTAINING FIXED-NITROGEN SPECIES

[75] Inventors: William Bartok, Westfield; Yih H. Song, Berkeley Heights; Vince J. Siminski, Rockaway, all of N.J.; John P. Longwell, Cambridge, Mass.

[73] Assignee: Exxon Research and Engineering Co., Florham Park, N.J.

[21] Appl. No.: 218,631

[22] Filed: Dec. 22, 1980

Related U.S. Application Data

[63] Continuation-in-part of Ser. No. 178,328, Aug. 15, 1980, abandoned.

[51] Int. Cl.[3] ..... F23M 3/04

[52] U.S. Cl. ..... 431/10

[58] Field of Search ..... 431/10, 11, 165; 110/344, 345, 348; 60/39.06

[56] References Cited

U.S. PATENT DOCUMENTS

| | | | |
|---|---|---|---|
| 3,048,131 | 8/1962 | Hardgrove | 110/72 |
| 3,955,909 | 5/1976 | Craig et al. | 431/10 |

*Primary Examiner*—Samuel Scott
*Assistant Examiner*—Randall L. Green
*Attorney, Agent, or Firm*—Richard E. Nanfeldt

[57] ABSTRACT

Fuels containing fixed-nitrogen chemical species are combusted in a multi-stage process. The process which converts substantially all of the fixed-nitrogen into molecular nitrogen (and thus avoids the formation of significant amounts of nitrogen oxides from the fixed-nitrogen) comprises six steps: (a) mixing the fuel with at least one first oxidizing agent in amounts such that the equivalence ratio of said fuel to said oxidizing agent is at least about 1.4; (b) partially combusting the mixture resulting from step (a) in at least one first stage at a first temperature of about 1750° to about 2150° K., with a residence time of at least 0.03 second to less than 0.2 second; (c) injecting a free radical agent into the partially combusted mixture of said fuel and said first oxidizing agent; (d) reacting the mixture of said free radical agent and said partially combusted mixture of said fuel and said first oxidizing agent for at least about 0.05 second to about 0.2 second; (e) mixing the reaction products resulting from step (d) with at least one second oxidizing agent in an amount such that the equivalence ratio of reaction products to the total amount of oxidizing agents in the mixture will be about 1.0 or less, such mixing taking place under conditions such that the temperature of the mixture will not exceed about 1800° K.; and (f) completely combusting the mixture resulting from step (e) in at least one second stage at a second temperature of less than about 1800° K.

14 Claims, 5 Drawing Figures

MULTI-STAGE PROCESS FOR COMBUSTING FUELS CONTAINING FIXED-NITROGEN SPECIES

This is a continuation-in-part of application, Ser. No. 178,328 filed Aug. 15, 1980, now abandoned, based on P.M. CAR-105-79.

SUMMARY OF THE INVENTION

The present invention relates to a multi-stage process for combusting a fuel containing fixed-nitrogen chemical species which comprises the steps of: (a) mixing said fuel with at least one first oxidizing agent in amounts such that the equivalence ratio of said fuel to said oxidizing agent is at least about 1.4; (b) partially combusting the mixture resulting from step (a) in at least one first stage at a first temperature of about 1750° to about 2150° K., with a residence time of at least 0.03 second to less than 0.4 second; (c) injecting a free radical agent into the partially combusted mixture of said fuel and said first oxidizing agent; (d) reacting the mixture of said free radical agent and said partially combusted mixture of said fuel and said first oxidizing agent for at least about 0.05 second to about 0.2 second; (e) mixing the reacction products resulting from step (d) with at least one second oxidizing agent in an amount such that the equivalence ratio of reaction products to the total amount of oxidizing agents in the mixture will be about 1.0 or less, such mixing taking place under conditions such that the temperature of the mixture will not exceed about 1800° K.; and (f) completely combusting the mixture resulting from step (e) in at least one second stage at a second temperature of less than about 1800° K.

It is well known that common fuels such as coal, coal liquids, diesel oils, bunker oils, crude oils, shale oils, natural gas, etc. contain varying amounts of fixed-nitrogen chemical species. It is also well known that combustion of such fuels will produce varying amounts of nitrogen oxides (e.g. 150–1500 ppm.), depending on the type and quantity of fixed-nitrogen chemical species as well as the furnace and burner arrangements.

It is axiomatic that it would be desirable to minimize the formation of nitrogen oxides without any significant impairment of the combustion efficiency. This desirable result has been achieved by means of the instant multi-stage combustion process, since this process results in the conversion of substantially all of the fixed-nitrogen chemical species contained in the fuel into innocous molecular nitrogen (rather than nitrogen oxides) without any significant concommitant impairment of combustion efficiency. P This invention relates to a method for the improvement of the rate of conversion of various fixed-nitrogen species found in a staged combustion process, as previously depicted in U.S. Ser. No. 855,548 (filed, Nov. 29, 1977, abandoned, and incorporated herein by reference) to molecular nitrogen by the addition of radical-producing compounds to the first, fuel rich ($\phi$=1.7–2.0) combustion stage at a discrete reaction time of about 50–150 msec and temperatures of about 1850–2050 K. The replenishment of the depleted radical pool by the reaction of the additives that produce free radicals can decrease the residence time and the reaction temperature required to achive greater than 90% conversion of the nitrogenous species to molecular nitrogen in the fuel rich stage of combustion.

The emission of nitrogen oxides from various combustion devices originates from two different sources.

First, thermal fixation of the molecular nitrogen portion of the air utilized for combustion occurs at high temperatures to produce various nitrogenous products such as $NO_x$, HCN and $NH_3$. Second, various nitrogenous species chemically combined with the fuel (fuels derived from high nitrogen content coals, shales, tar or coal itself) produce nitrogen oxides, $NH_3$ and HCN in fuel rich combustion. It has been found, however, that in conventional staged combustion processes with first stage heat extraction where the $\phi$ value in the primary combustion stage is between about 1.0 and 1.2 the total concentration of fixed nitrogen species can be reduced by only about 50%. As disclosed in U.S. Ser. No. 855,548, greater than 90% conversion of the fixed nitrogen species to $N_2$ is achievable in the highly fuel rich first stage by increasing the combustion temperature to accelerate the rate of nitrogen species conversion to $N_2$ which is favored by thermodynamic equilibrium under such conditions.

PRIOR ART

U.S. Pat. No. 3,048,131 teaches a two-stage method for combusting nitrogen-containing fuels in order to minimize the production of $NO_x$ species in the combustion products. However the results achieved by the instant process surpass those of this patent. Moreover, this patent contains no teaching whatsoever of the six critical steps (outlined above) of this process.

The M.S. thesis by Howard W. Chou entitled "Fate of Ammonia In Fuel Rich Flames" (deposited in the library of the Massachusetts Institute of Technology on Oct. 25, 1976) indicates the desirability of combusting fuels under fuel-rich conditions (i.e., high equivalence ratios) and at elevated temperatures. However, the Chou thesis does not indicate the necessary residence times for the first stage combustion. Moreover, Chou did his work at flame temperatures corresponding to adiabatic or less and at equivalence ratios greater than unity. In contrast, thereto, this process involves three inter-related parameters in the first stage: high temperatures (e.g. 1950°–2400° K.), high equivalence ratios (e.g. at least 1.2) and minimum residence times (e.g. at least 0.01 second).

Other relevant prior art processes are summarized in the paper entitled "Mechanisms and Kinetics/$NO_x$ Formation" by A. F. Sarofim et al. which was presented at the 69th Annual meeting of the American Institute of Chemical Engineers on Nov. 30, 1976 and is incorporated herein by reference.

DETAILS OF THE PRESENT INVENTION

Figure 1:
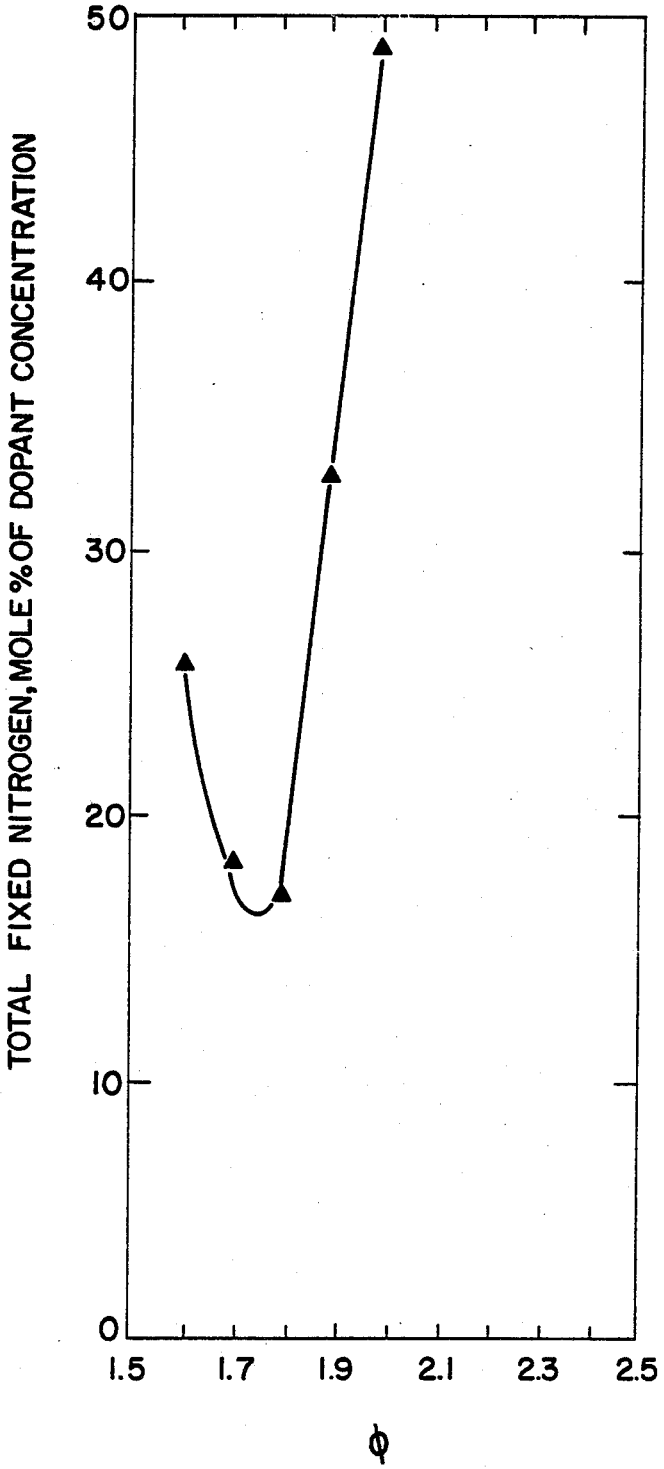
FIG. 1 is a plot of total fixed nitrogen, percent of dopant concentration versus equivalence ratio.

This combustion process is multi-stage in nature, i.e., it involves one or more first stages and one or more second stages. The combustion process may be practiced with any desired type of combustion chamber/burner, so long as the chamber/burner is capable of being utilized in accordance with the six critical steps outlined above. Further, the same combustion chamber(s) employed in the second stage(s) may be the same or as different from that employed in the first stage(s).

The first step of this process involves mixing a fuel with a first oxidizing agent. The fuel may be a solid, a liquid, a gas or a mixture thereof such as the common fuels previously mentioned. The quantity and type of fixed-nitrogen chemical species contained in the fuel is relatively unimportant; however, most common fuels contain less than about 5 wt. % of such chemical species.

Typically, the first oxidizing agent is air; however oxygen, oxygen mixed with an inert gas such as helium, etc. may also be employed instead of air. If desired, the air may be enriched with oxygen, e.g. 6–15 wt. % of oxygen may be added to the air, based on the weight of the additional oxygen plus air. Further, it may also be useful to pre-heat the air to a temperature in the range of 450° to 1100° K. preferably 600°–900° K. prior to its admixture with the fuel. If desired, the fuel may also be pre-heated to similar temperatures prior to admixture with the air.

The amount of oxidizing agent mixed with the fuel is such that an equivalence ratio of at least about 1.4 is obtained; preferably, the equivalence ratio is in the range of 1.4 to 2.2, most preferably 1.6 to 2.0. The equivalence ratio (usually referred to as $\phi$) is defined as:

$$\text{equivalence ratio } (\phi) = \frac{\dfrac{\text{actual fuel}}{\text{actual oxidizing agent}}}{\dfrac{\text{stoichiometric fuel}}{\text{stoichiometric oxidizing agent}}}$$

For complete combustion (e.g., oxidation of carbon monoxide to carbon dioxide), $\phi$ should be equal to or less than 1.0. Where $\phi$ has a value equal to or greater than 1.4, carbon will be oxidized to carbon monoxide plus carbon dioxide. It should be noted that while a condition of $\phi \leqq 1.0$ is desirable from a complete combustion point of view, such condition favors conversion of fixed-nitrogen chemical species into nitrogen oxides. Thus by combusting in at least two stages in which the first stage(s) $\phi > 1.4$ and the second stage(s) $\phi \leqq 1.0$, both minimization of the formation of nitrogen oxides and maximization of complete combustion are obtained.

The mixture of fuel and first oxidizing agent may be formed externally to, or within, a suitable combustion chamber. In the second step of this process, the mixture is partially combusted (i.e. carbon is oxidized to carbon monoxide plus carbon dioxide) in at least one first stage. The combustion temperature of this first stage is maintained in the range of about 1750° to about 2150° K., preferably 1800° to 1950° K. Further, the residence time of the fuel and oxidizing agent during the partial combustion reaction is maintained at a level of about 0.03 to 0.4 second, preferably 0.05 to 0.2 sec., more preferably about 0.05 to 0.1 second.

The third step of the process includes the injecting of a free radical source into the mixture of partially combusted fuel and first oxidizing agent at combustion temperature of about 1750° to 2150° K. By injecting the free radical source it is possible to operate step (b) in the first stage of the combustion process at lower temperatures than without injection because of the accelerating effect of the free radical source on the fixed nitrogen conversion rate. The free radical source can be a free radical chemical agent or alternatively free radicals generated in situ by external means such as by a high voltage charge means. The free radical chemical agents can be selected from any known organic or inorganic chemical compound which will generate free radical species at a temperature of about 1750°–2150° K. Typical, non-limiting examples of suitable free radical chemical agents are air, oxygen, fuel, steam, $H_2O_2$, alkyl or aryl peroxides, and azo-compounds and mixtures thereof. The concentration of free radical chemical agent is about 0.1 to about 5.0 volume % of the combined volume of fuel and the first oxidizing agent, preferably about 0.2 to 3 volume %, more preferably about 0.3 to about 2 volume %. It should be noted that if $O_2$ or other oxidizing agent are used as the free radical chemical agent, the $O_2$ or oxidized agent is added in sufficiently low quantities such that the mixture of fuel and first oxidizing agent which has been partially combusted remains fuel rich thereby negating any possibility of the adverse generation of additional fixed nitrogen species. The injection of the free radical chemical agent into the partially combusted mixture of fuel and first oxidizing agent provides a means for re-acceleration of the conversion of fixed nitrogen species to molecular $N_2$, since even at high temperature after the initial rapid conversion of fixed nitrogen species to molecular $N_2$, the process slows down. The addition in small concentrations of the free radical chemical agent overcomes this undesirable effect by replenishment of the concentration of the depleting free radical pool.

The fourth step of the instant process comprises the reaction of the mixture of the partially combusted fuel and first oxidizing agent with the free radical chemical agent at a temperature of about 1750° to about 2150° K. for about 0.05 second to about 0.2 second, preferably about 0.1 to about 0.15 second.

The reaction products resulting from the fourth step are then mixed in a fifth step with a second oxidizing agent (which may be the same or different from the first oxidizing agent employed in the first step). Typically, the second oxidizing agent is also air, but it may be any of the other choices enumerated above for the first oxidizing agent. The amount of oxidizing agent employed in the fifth step is such that the equivalence ratio of reaction products to the total amount of oxidizing agents (i.e. any remaining first oxidizing agent plus the added second oxidizing agent) is equal to or less than 1.0, e.g. 0.80–0.99.

Since an equivalence ratio of 1.0 or less favors the formation of $NO_x$ species at elevated temperatures, it is necessary that the mixing in the fifth step take place under conditions such that the temperature of the reaction products—second oxidizing agent mixture is maintained at a level not in excess of about 1800° K., e.g. 1200°–1750° K. This may be readily accomplished by several techniques, e.g. cooling of the combustion chamber, transfer of the reacting products to a different "cold" combustion chamber, cooling of the reaction products (e.g. by suitable heat exchangers) to a temperature of less than 1300° K. Furthermore, cooling may not necessarily be required, e.g. the temperature of the reaction products in relation to the temperature, requisite amount, and rate of mixing, of the second oxidizing agent may be such that the temperature will at all times be below about 1800° K.

The mixing of reaction products and second oxidizing agent may, as in the case of the first step, take place external to, or within the same or different combustion chamber as was employed in the first stage combustion (i.e. the second step). Further, where the second oxidizing agent is chosen to be air, the air may be enriched with the same levels of additional oxygen as mentioned above with respect to the first oxidizing agent (provided that an equivalence ratio of $\leqq 1.0$ is maintained for the mixture).

The second oxidizing agent (e.g. air) may be preheated and/or enriched with oxygen as was the case with respect to the first oxidizing agent. Further, the second oxidizing agent may be diluted with combustion products and/or inert gases prior to and/or during admixture with the reaction products resulting from the fourth step. These alternatives, however, are subject to the proviso that the equivalence ratios and maximum temperatures outlined above must nevertheless be maintained.

In the sixth step, the mixture of reaction products and second oxidizing agent is completely combusted in at least one second stage (in the same or different combustion chamber as that employed in the first stage combustion). The term "completely" combusted is used herein to denote that partially oxidized combustion products (e.g. carbon monoxide) resulting from the first stage combustion are further oxidized to their highest oxidation state (e.g. carbon dioxide). The sixth step is carried out at a temperature of less than about 1800° K., preferably 1200° to 1750° K. The residence times for the second stage are not critical, i.e. they need be only long enough to oxidize substantially all of the carbon monoxide (from the first stage combustion) into carbon dioxide. Typically, residence times of 0.1 to 1.0 second will be sufficient for the second stage combustion. For boilers or process furnaces, residence times of 0.5 to 1.0 second are anticipated. For gas turbines, the second stage residence time will be shorter, typically less than 0.1 second.

COMPARATIVE EXAMPLE 1

In this example and in Example 2 below, attention was focused on the first stage of the combustion process. Once the conversion of fixed-nitrogen chemical species to molecular nitrogen has been maximized by the first stage process conditions of this invention, completing the combustion in the second stage (at equivalence ratios of 1.0 or less) and at lower temperatures (about 1750° K or less) presents no problem vis-a-vis minimization of $NO_x$ formation.

The apparatus employed in Example 1 consisted of an electrically-heated vertical muffle-tube furnace; the furnace was constructed of zirconia and was 5.40 cm I.D.$\times$60.64 cm. long (the heated zone was 35.56 cm. long). The reactants (i.e. premixed fuel and air) were fed to the bottom of the muffle-tube through a porous plug flat flame burner of 2.54 cm. diameter (the face of the burner was located 4.92 cm. below the heated zone). Gas samples for analysis of $O_2$, NO and $NO_x$ were withdrawn through a water-cooled stainless steel probe that was axially located 41.91 cm. above the burner face. Gas samples for analysis of HCN and $NH_3$ were withdrawn from the cool burner exhaust duct, approximately 99 cm. above the burner face.

In Example 1, methane was doped with approximately 5,000 ppm NO and mixd with air so as to result in a mixture having an equivalence ratio of 1.7. The results in terms of the output of the sum of NO, $NH_3$ and HCN as a mole percent of the input NO versus various adiabatic flame temperatures are shown in Table I below.

TABLE I

| Output, Mole % | Flame Temp., °K. |
|---|---|
| 30.7 | 1762 |
| 17.3 | 1824 |
| 10.5 | 1884 |
| 8.04 | 1940 |
| 6.57 | 1994 |
| 6.32 | 2045 |

COMPARATIVE EXAMPLES 2-6

The experimental apparatus described in Example 1 was used with some modifications to obtain the results presented in the examples that follow. All of the experimental data were obtained in a $NH_3$ doped, premixed methane-nitrogen oxygen system that was reacted in an isothermal combustor where the wall temperature was matched to the theoretical adiabatic combustion temperature of the flame corresponding to each set of test conditions. The 2.54 cm. diameter porous flat flame burner of Example 1 was replaced by a 5.0 cm. diameter porous plate flat flame burner in the bottom end of the vertical furnace reactor. Most of the data were obtained using a vertical tubular furnace constructed of zirconia with dimensions of 5.40 cm. I.D. by 60.64 cm. long (the heated zone was 35.56 cm. long). In a few test runs, a furnace constructed of alumina with the same dimensions was used without any noticeable effect on the reaction products. Combustion reaction product compositions were determined by withdrawing samples isokinetically through a quartz lined water cooled stainless steel probe that was inserted into the furnace from the top and could be moved by external actuation to predetermined axial positional along the center of the furnace. The tip of the sampling probe was positioned to correspond to the reaction time requirements specified for the isothermal plug flow reaction zone in each series of tests.

EXAMPLE 2

The experimental results were obtained at a constant reaction time of 300 msec isothermally at a temperature of 1850° K. to determine the effect of the equivalence ratio on the total fixed nitrogen content of the combustion products. FIG. 1 presents the results in graphical form as a plot of the sum of total fixed nitrogen expressed as the percent of the input $NH_3$ (600 ppm) added to the premixed methane-nitrogen-oxygen mixture. In these experiments, the amount of oxygen used was adjusted to provide the selected conditions of equivalence ratio and adiabatic flame temperature for each test run.

The results of FIG. 1 clearly show that a minimum occurs in the value of the total fixed nitrogen (sum of the concentrations of NO, $NH_3$ and HCN) at a value of the equivalence ratio of about 1.75). This minimum value is about 20% of the input ammonia.

EXAMPLE 3

The results of Example 3 were obtained again using premixed reactants of methane, oxygen, nitrogen and ammonia. As in Example 2, the input ammonia concentration was 600 ppm. For this set of test runs, the reaction temperature in the furnace was controlled at 1950° K.

Figure 2:
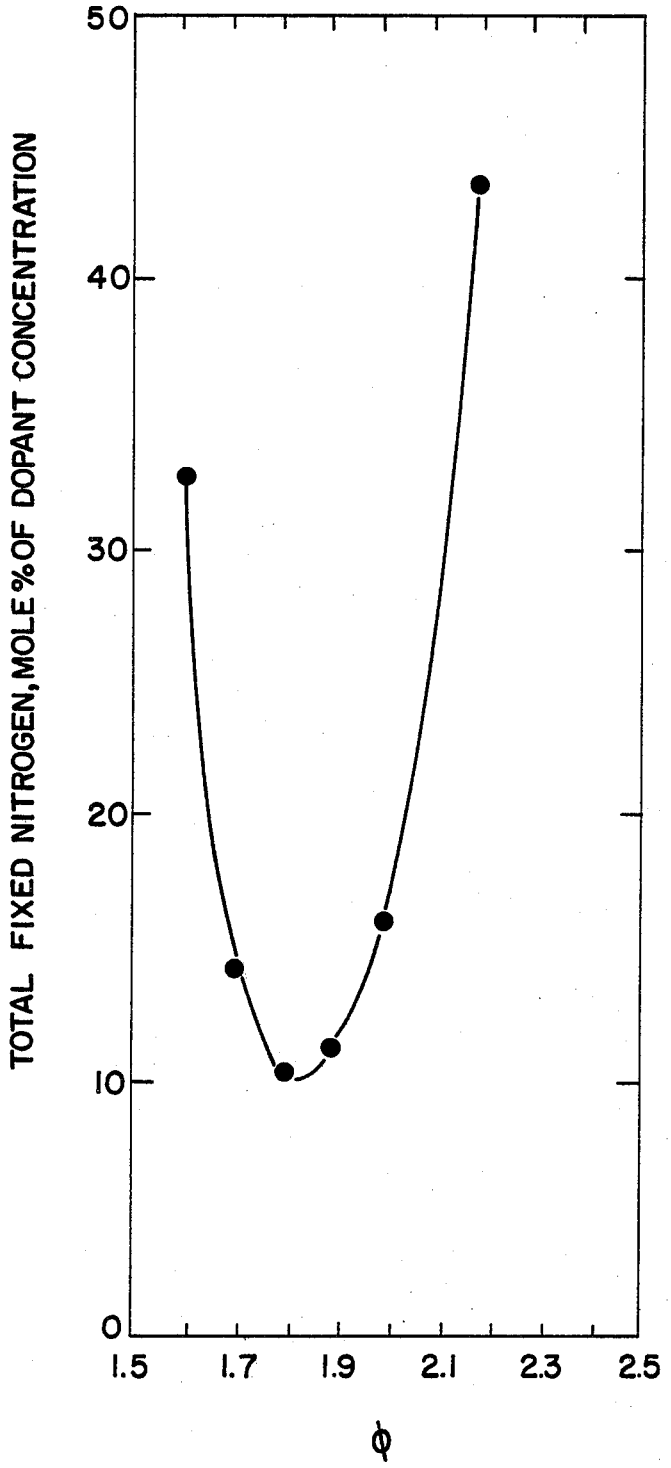
FIG. 2 is a plot of total fixed nitrogen, percent of dopant concentration versus equivalence ratio.

Consistent with the teaching of the present invention, the minimum value of the fixed nitrogen concentration (again expressed as the percent of the input $NH_3$) decreased to a lower value at 1950° K. compared to the results obtained at 1850° K. As shown by the results in FIG. 2, the minimum value of the fixed nitrogen is about 10% of the input $NH_3$ at a value of the equivalence ratio of about 1.0. Comparison of FIGS. 1 and 2 shows that the entire curve of fixed nitrogen plotted as a function of the equivalence ratio is shifted to lower values by raising the temperature.

EXAMPLE 4

Figure 3:
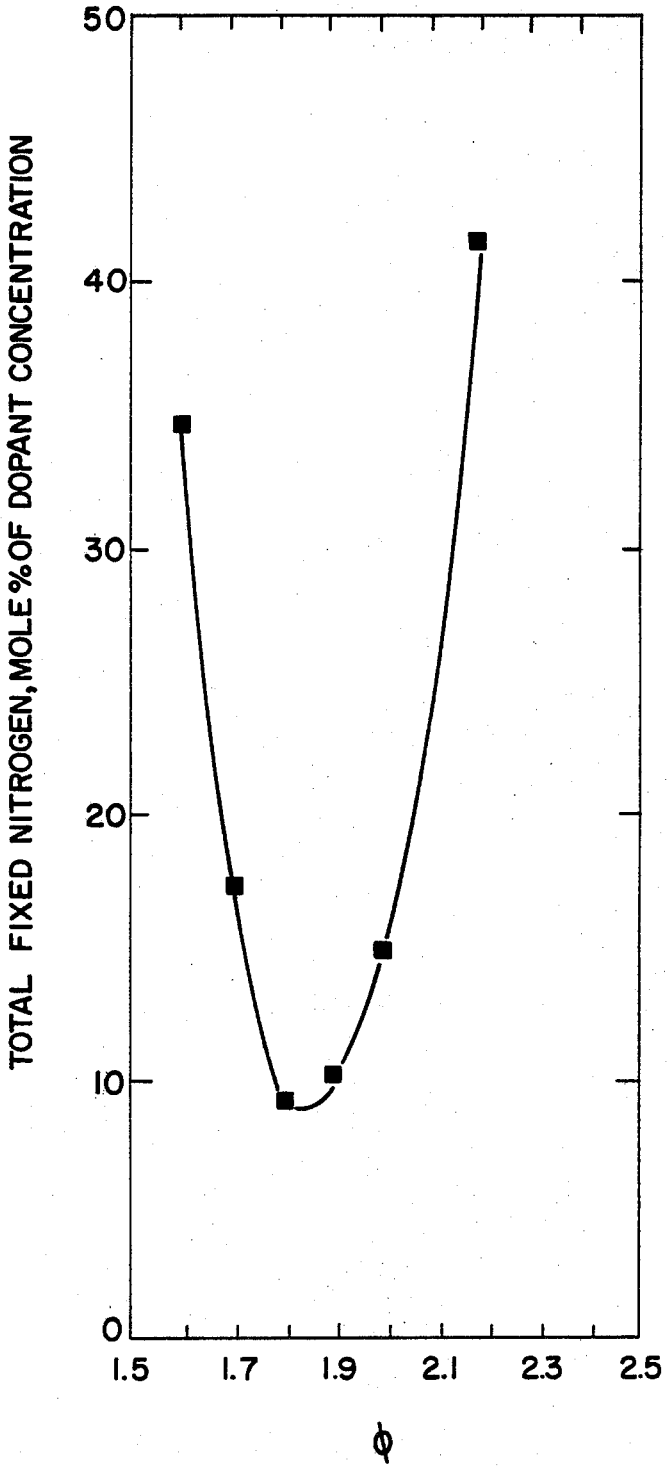
FIG. 3 is a plot of the total fixed nitrogen, percent of dopant concentration versus equivalence ratio.

The effect of reaction temperature was studied further at 2050° K. using methane, oxygen, nitrogen and ammonia mixtures with an input concentration of 600 ppm $NH_3$. As shown by the results in FIG. 3 which presents fixed nitrogen plotted vs. equivalence ratio at 2050° K. in 300 msec, a further reduction in fixed nitrogen can be achieved by this increase in temperature at about 100 =1.85 to a value of about 8% of the input of $NH_3$.

The trend for the value of $\phi$ corresponding to minimum fixed nitrogen to shift to higher values with increasing temperature is consistent with thermodynamic equilibrium calculations for such reactant mixtures.

EXAMPLE 5

In this set of experiments, mixtures of methane, nitrogen and 600 ppm $NH_3$ were reacted at a temperature of 1850° K. and a value of $\phi=1.6$, as a function of reaction time up to 300 msec. The $\phi$ value was selected to correspond to the minimum in fixed nitrogen previously determined for 300 msec and 1850° K. in Example 2.

Figure 4:
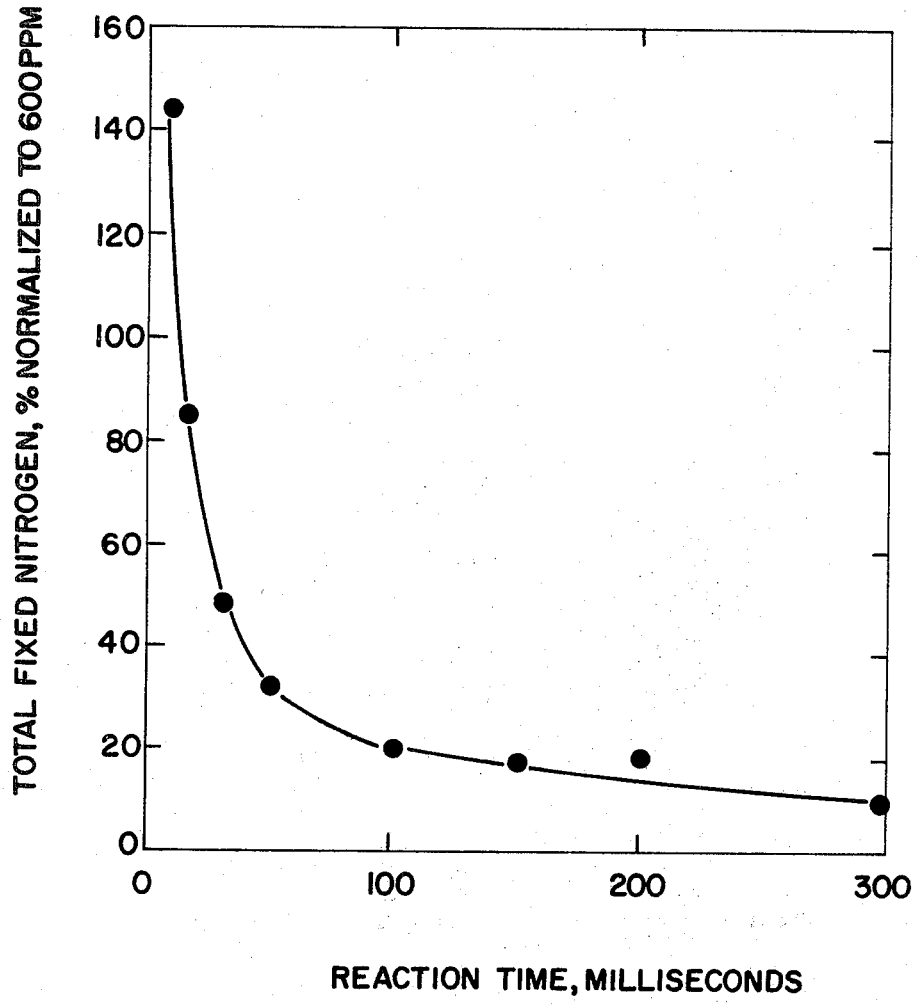
FIG. 4 is a plot of total fixed nitrogen, percent normalized to 600 ppm versus reaction time.

FIG. 4 shows the results of these time resolved measurements. Following an initial transient buildup in fixed nitrogen, presumably due to some further fixation of atmospheric nitrogen, the fixed nitrogen concentration of the fuel rich combustion products decreases rapidly with reaction time for about the first 100 msec. It is seen that after about 50 msec, about 30% of the $NH_3$ input remains as fixed nitrogen. After 100 msec, the fixed nitrogen decreases to about 27% and after about 200 msec, 22% of the $NH_3$ input.

EXAMPLE 6

A similar test of time resolved measurements as in Example 5 were made, but at a higher temperature of 1950° K. Again reactant mixtures of premixed methane, oxygen, nitrogen and 600 ppm $NH_3$ were used. At a reaction temperature of 1950° K., the $\phi$ value selected was 1.8 to correspond to the minimum in fixed nitrogen observed in the results presented in Example 3.

Figure 5:
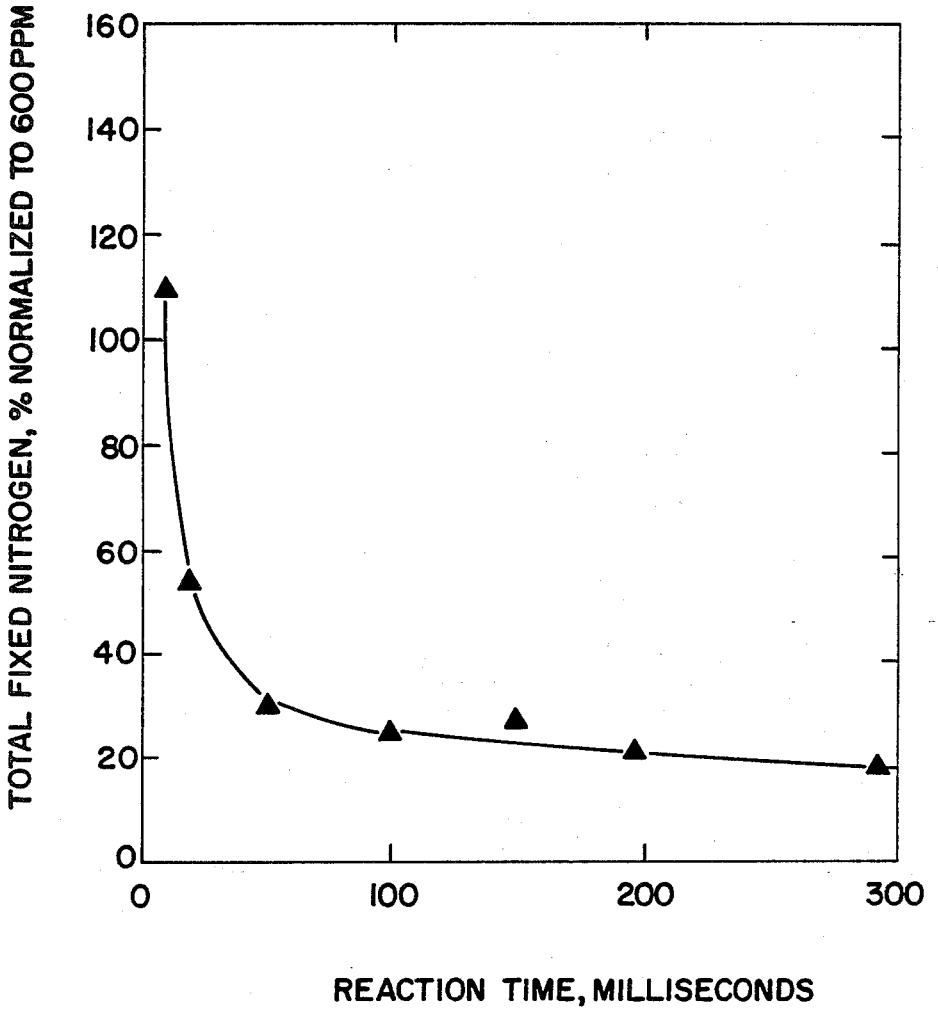
FIG. 5 is a plot of total fixed nitrogen, percent normalized to 600 ppm versus reaction time.

The results are presented in FIG. 5. After an initial transient increase in the concentration of fixed nitrogen species, their concentration decreases even more rapidly with reaction time than at the lower temperature of Example 5. Because of the initial larger increased in fixed nitrogen, the actual values of fixed nitrogen concentration are seen to be higher at 1950° K. than at 1850° K. up to a reaction time of about 60 msec (at that reaction time the fixed nitrogen is about 30% of the $NH_3$ input). At 100 msec the fixed nitrogen is about 22% of the $NH_3$ input, at 200 msec it is about 15%, and at 300 msec it is about 10% of the $NH_3$ input.

EXAMPLE 7

The experimental apparatus described in Example 1 and the procedure as exemplified in Examples 2–6 were used except that a free radical agent was injected into the partially combusted mixture of the fuel and the first oxidizing agent in the first stage.

A specially designed injector system was used for introducing free radical sources into the partially combused fuel-oxidizer mixture. The injector consisted of a ⅛" OD single-bore (for single additives) or double-bore (for multi-component additives) tube attached to a four- or six-nozzle cylindrical head of 0.065" ID×0.265" OD about 0.3–0.5" long. The nozzles, located on the upper portion of the head, were 0.008" diameter. In the case when multi-component additives were used as additives, the injector head was designed to be long enough to provide adequate mixing of additive components which were introduced through separate passages, and short enough to prevent preignition before injection into the main gas stream. The injector assembly was inserted through a central passage of the flat flame burner, with the injector head extended into the inside of the reaction chamber. The injector head was then positioned to provide an injection location which corresponded to the predetermined reaction time.

The improvements in the combustion process as exemplified by the injection of the free radical agent are summarized in Tables II–VIII. Small differences in measured concentrations between these examples and those illustrated in Examples 2–6 are within the limits of experimental reproducibility.

TABLE II

Feed: $CH_4/O_2/N_2/NH_3$
T = 1750K and $\phi$ = 1.6
Injection of $O_2$ @ 400 msec

| Injection Rate (Vol. % of feed to burner) | TFN*@ 600 msec (% of dopant in feed) | % Improvement in TFN Conversion to $N_2$** |
|---|---|---|
| 0 | 65 | |
| 1 | 45 | 31 |
| 1½ | 32 | 51 |
| 2 | 23 | 65 |
| 2¼ | 18 | 72 |
| 2½ | 14 | 78 |
| 2¾ | 18 | 72 |

*TFN = Total Fixed Nitrogen

** $\left(1 - \frac{\text{TFN With Injection}}{\text{TFN Without Injection}}\right) \times 100$

TABLE III

Feed: $CH_4/O_2/N_2/NH_3$
T = 1850K and $\phi$ = 1.7
Injection of $O_2$ @ 50 msec

| Injection Rate (Vol. % of feed to burner) | TFN*@ 100 msec (% of dopant in feed) | % Improvement in TFN Conversion to $N_2$** |
|---|---|---|
| 0 | 26 | |
| ⅓ | 21 | 19 |
| ½ | 28 | −8 |

TABLE IV

Feed: $CH_4/O_2/N_2/NH_3$
T = 1850K and $\phi$ = 1.7
Injection of $O_2$ @ 100 msec

| Injection Rate (Vol. % of feed to burner) | TFN*@ 200 msec (% of dopant in feed) | % Improvement in TFN Conversion to $N_2$** |
|---|---|---|
| 0 | 25 | |
| ¼ | 23 | 8 |
| ½ | 19 | 24 |
| ¾ | 25 | 0 |
| 1 | 27 | −8 |

TABLE V

Feed: $CH_4/O_2/N_2/NH_3$
T= 1850K and $\phi$ = 1.7
Injection of $O_2$ @ 100 msec

| Injection Rate (Vol. % of feed to burner) | TFN*@ 300 msec (% of dopant in feed) | % Improvement in TFN Conversion to $N_2$** |
|---|---|---|
| 0 | 17 | |
| ½ | 14 | 18 |

*TFN = Total Fixed Nitrogen

** $\left(1 - \frac{\text{TFN With Injection}}{\text{TFN Without Injection}}\right) \times 100$

TABLE VI

Feed: $CH_4/O_2/N_2/NH_3$
T = 1950K and $\phi$ = 1.8
Injection of $O_2$ @ 100 msec

| Injection Rate (Vol. % of feed to burner) | TFN*@ 300 msec (% of dopant in feed) | % Improvement in TFN Conversion to $N_2$** |
|---|---|---|
| 0 | 14 | |
| ⅛ | 14 | 0 |
| ¼ | 13.5 | 4 |
| ½ | 12.5 | 11 |
| ¾ | 15 | −7 |

TABLE VII

Feed: $CH_4/O_2/N_2/NH_3$
T = 1850K and $\phi$ = 1.7
Injection of $CH_4/O_2$ ($\phi$ = 1.7) @ 100 msec

| Injection Rate (Vol. % of feed to burner) | TFN*@ 200 msec (% of dopant in feed) | % Improvement in TFN Conversion to $N_2$** |
|---|---|---|
| 0 | 26 | |
| ¾ | 25 | 4 |
| 1 | 23 | 12 |
| 1½ | 23 | 12 |
| 2 | 23 | 12 |

*TFN = Total Fixed Nitrogen

** $\left(1 - \frac{\text{TFN With Injection}}{\text{TFN Without Injection}}\right) \times 100$

TABLE VIII

Feed: $CH_4/O_2/NH_2/NH_3$
T = 1750K and $\phi$ = 1.6
Injection of $CH_4/O_2$ ($\phi$ = 1.6) @ 400 msec

| Injection Rate (Vol. % of feed to burner) | TFN*@ 600 msec (% of dopant in feed) | % Improvement in TFN Conversion to $N_2$** |
|---|---|---|
| 0 | 66 | |
| 1 | 61 | 8 |

TABLE VIII-continued

Feed: $CH_4/O_2/NH_2/NH_3$
T = 1750K and $\phi$ = 1.6
Injection of $CH_4/O_2$ ($\phi$ = 1.6) @ 400 msec

| Injection Rate (Vol. % of feed to burner) | TFN*@ 600 msec (% of dopant in feed) | % Improvement in TFN Conversion to $N_2$** |
|---|---|---|
| 2 | 58 | 12 |
| 2½ | 41 | 38 |
| 3 | 38 | 43 |
| 4 | 39 | 41 |
| 5 | 38 | 43 |
| 6 | 38 | 43 |

*TFN = Total Fixed Nitrogen

** $\left(1 - \frac{\text{TFN With Injection}}{\text{TFN Without Injection}}\right) \times 100$

What is claimed is:

1. A process for converting fixed nitrogen into molecular nitrogen in a multistage combustion process comprising:

(a) mixing a fuel with at least one first oxidizing agent in amounts such that the equivalence ratio of said fuel to said first oxidizing agent is at least about 1.4;

(b) partially combusting the mixture resulting from step (a) in at least one first stage at a first temperature of about 1800° to 1950° K., with a residence time of at least 0.03 second to less than 0.4 second;

(c) injecting a free radical agent into the partially combusted mixture of said fuel and said first oxidizing agent;

(d) reacting the mixture of said free radical agent and said partially combusted mixture of said fuel and said first oxidizing agent for at least about 0.05 second to about 0.2 second;

(e) mixing the reaction products resulting from step (d) with at least one second oxidizing agent in an amount such that the equivalence ratio of reaction products to the total amount of oxidizing agents in the mixture will be about 1.0 or less, such mixing taking place under conditions such that the temperature of the mixture will not exceed about 1800° K.; and (f) completely combusting the mixture resulting from step (e) in at least one second stage at a second temperature of about 1200° K. to less than about 1800° K.

2. The process according to claim 1, wherein the residence time is at least 0.05 second.

3. The process according to claim 1, wherein the equivalence ratio of the mixture resulting from step (a) is in the range of about 1.6 to about 2.0.

4. The process according to claim 1, wherein the first oxidizing agent is air.

5. The process according to claim 4, wherein the air is pre-heated to less than about 900° K. prior to its admixture with said fuel.

6. The process according to claim 1, wherein the fuel is a solid, liquid, gas, or a mixture thereof.

7. The process according to claim 1, wherein the second oxidizing agent is air.

8. The process according to claim 1, wherein a concentration of said free radical agent is about 0.1 to about 5.0 volume percent of the combined volume of said fuel and said first oxidizing agent.

9. The process according to claim 1 wherein a concentration of said free radical agent is about 0.2 to about 3.0 volume percent of the combinwed volume of said fuel and said first oxidizing agent.

10. The process according to claim 1, wherein a concentration of said free radical agent is about 0.3 to 2.0 volume % of the combined volume of said fuel and said first oxidizing agent.

11. The process according to claim 1, wherein said first oxidizing agent is reacted with said fuel at about 0.05 to about 0.2 seconds.

12. The process according to claim 1, wherein said first oxidizing agent is reacted with said fuel at about 0.05 to about 0.1 seconds.

13. The process according to claim 8, wherein said free radical agent is selected from the group consisting of air, oxygen, fuel, steam, hydrogen peroxide, alkyl or aryl peroxides and azo compounds.

14. The process according to claim 1, wherein said free radical agent is reacted with partially combusted mixture of said fuel and said first oxidizing agent at about 0.1 to about 0.15 seconds.

* * * * *